US005522290A

United States Patent [19]

Visser et al.

[11] Patent Number: 5,522,290

[45] Date of Patent: Jun. 4, 1996

[54] COMPLIANT PLIERS

[76] Inventors: Steven C. Visser, 271 E. Sunset La.; Ashok Midha, 2233 Carberry Dr., both of West Lafayette, Ind. 47906

[21] Appl. No.: 228,831

[22] Filed: Apr. 18, 1994

[51] Int. Cl.[6] ..... B25B 7/00

[52] U.S. Cl. ..... 81/427; 81/417; 294/99.2

[58] Field of Search ..... 81/427, 64, 91.3, 81/44, 3.8, 487, 900; 294/99.2

[56] References Cited

U.S. PATENT DOCUMENTS

| | | | |
|---|---|---|---|
| 1,863,704 | 6/1932 | Sueper | 81/487 X |
| 3,282,137 | 11/1966 | Lovelace | 294/99.2 X |
| 3,398,746 | 8/1968 | Abramson | 81/427 |
| 4,185,523 | 1/1980 | Kreitz | 81/417 |
| 4,192,204 | 3/1980 | Feldman | 294/99.2 X |
| 4,698,051 | 10/1987 | Jacobson | 81/487 X |

FOREIGN PATENT DOCUMENTS

| | | | |
|---|---|---|---|
| 2501417 | 7/1975 | Germany | 81/427 |

OTHER PUBLICATIONS

Salamon, Brent A., "Mechanical Advantage Aspects in Compliant Mechanisms Design," M. S. Thesis, Purdue University, Dec. 1989, pp. 43 and 87.

*Primary Examiner*—D. S. Meislin

*Attorney, Agent, or Firm*—Barnes & Thornburg

[57] ABSTRACT

The pliers include an endless loop, a top jaw appended to the endless loop, and a bottom jaw appended to the endless loop. The endless loop includes in series a top grip handle, a spring segment, a bottom grip handle and a compliant strip interconnecting the top and bottom grip handles. A rolling surface on the top grip handle rolls on a contact portion of the bottom grip handle. The rolling action causes the compliant strip to flex which causes the top and bottom jaws to move toward one another. The endless loop provides a built-in automatic spring and enhances lateral stability.

33 Claims, 4 Drawing Sheets

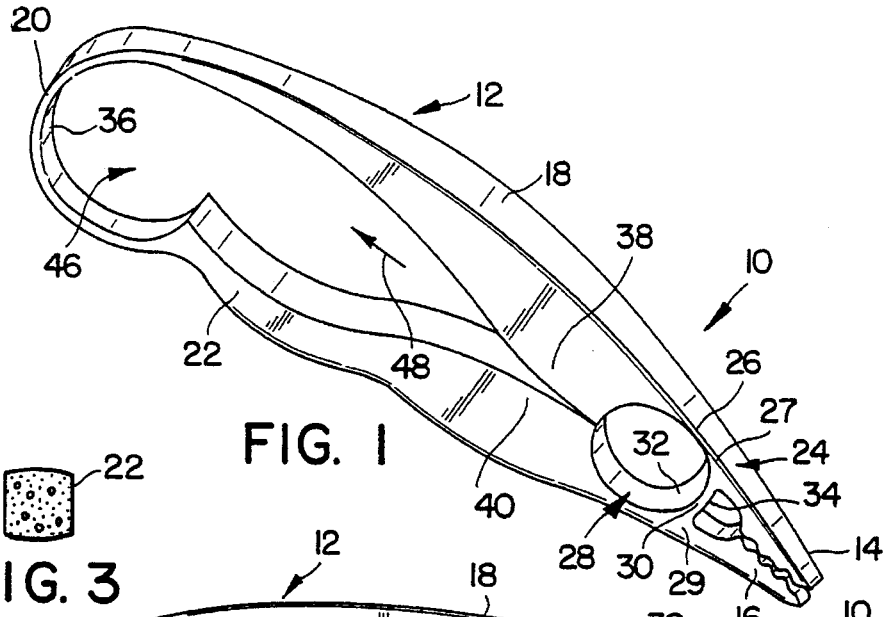
FIG. 1
FIG. 3
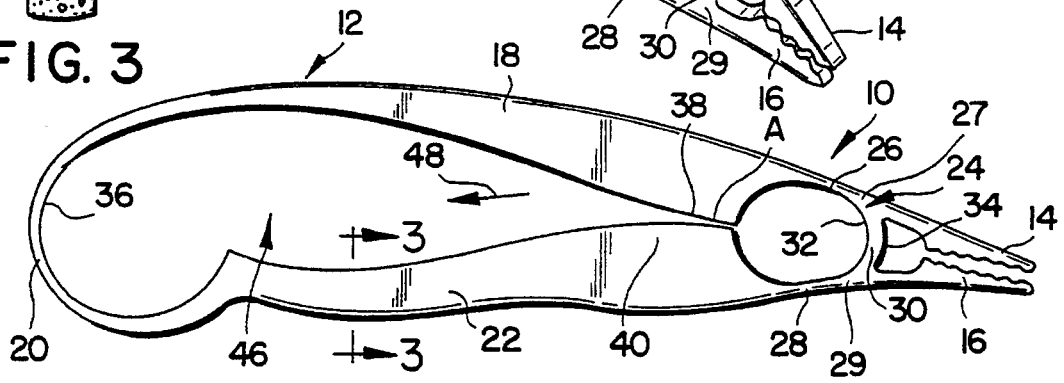
FIG. 2
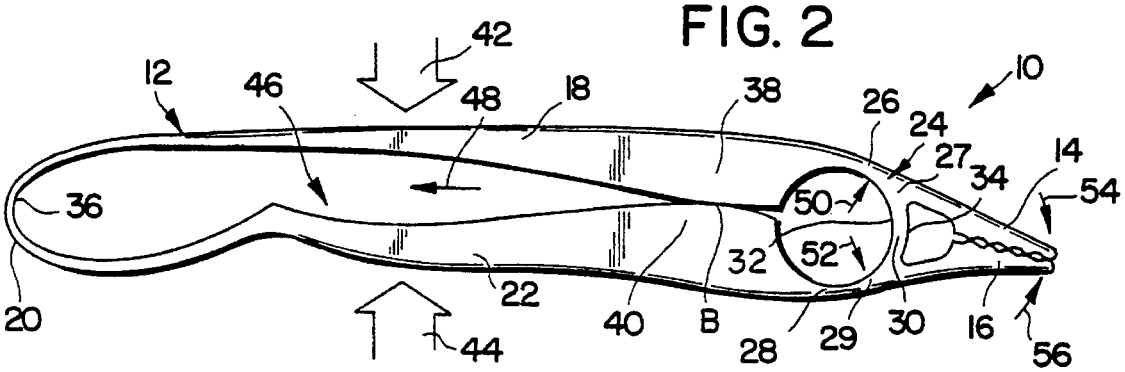
FIG. 4
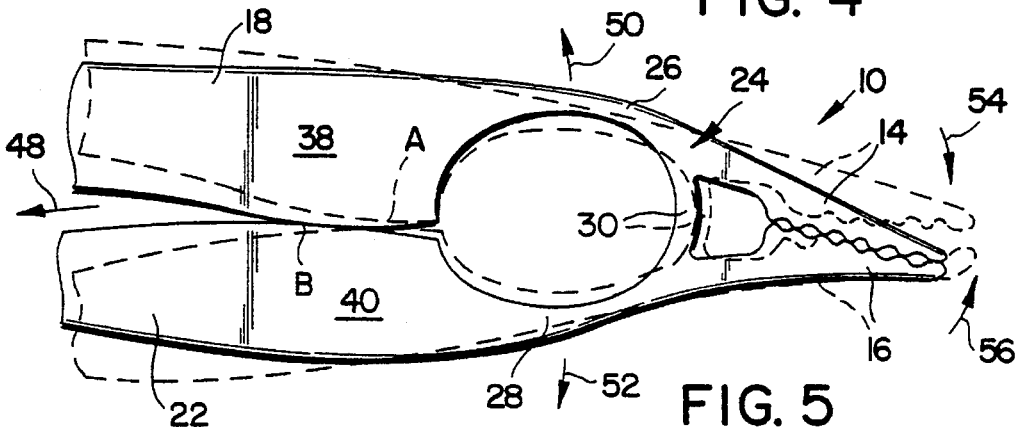
FIG. 5

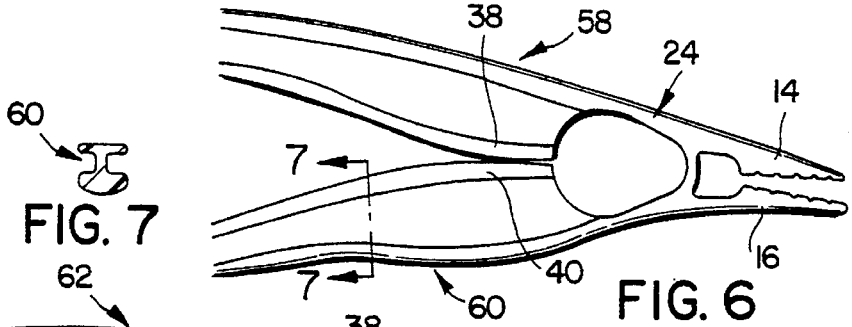
FIG. 6
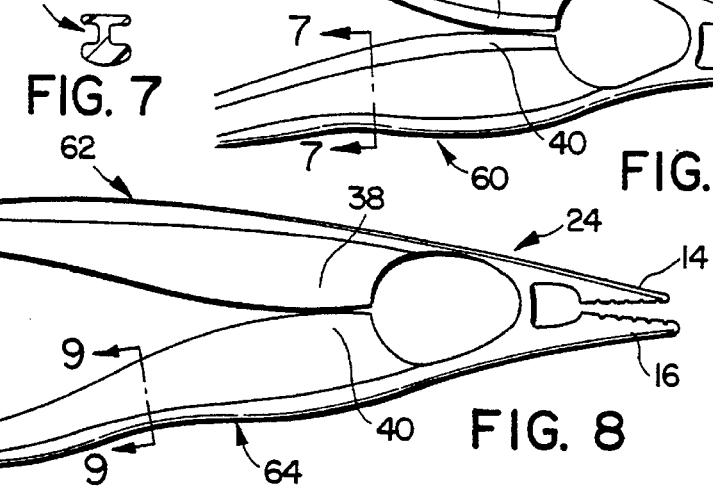
FIG. 8
FIG. 7
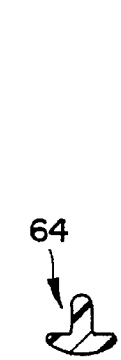
FIG. 9
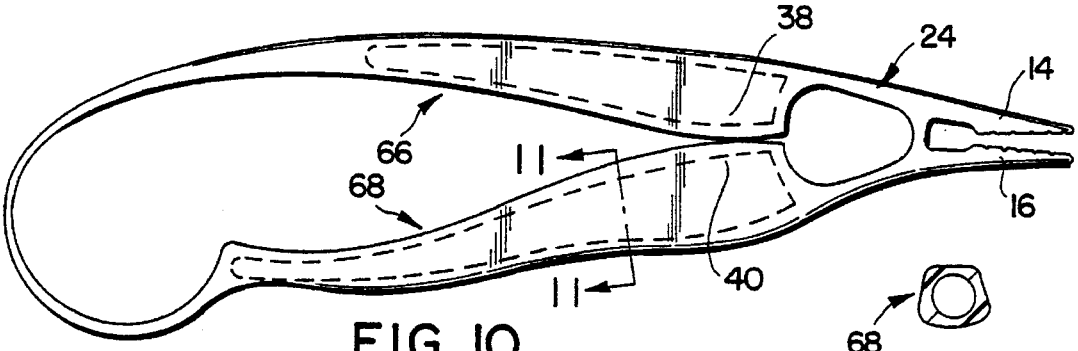
FIG. 10
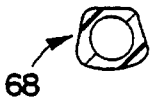
FIG. 11
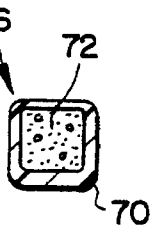
FIG. 13
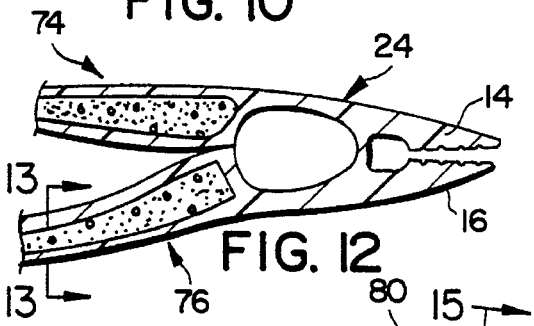
FIG. 12
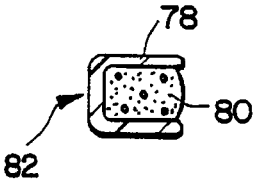
FIG. 15
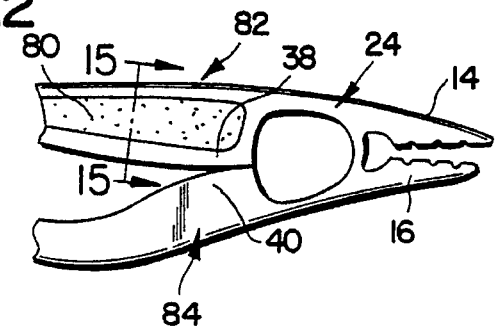
FIG. 14

COMPLIANT PLIERS

BACKGROUND AND SUMMARY OF THE INVENTION

This invention relates to hand tools, and particularly to mechanisms for holding or gripping objects. More particularly, this invention relates to compliant pliers.

Traditional pliers of the type commonly found in the home or workplace are made of a rigid-body structure. The members that make up the rigid-body structure are stiff and are connected at various pivot points to gain mobility and create a mechanical advantage. Mechanical advantage is the advantage gained by use of a mechanism in transmitting force such as by manually gripping the handles of the pliers so that an object gripped by the jaws of the pliers is held tightly.

A compliant mechanism includes some portions that flex while the other portions remain rigid. Compliance generally is the ability of an object to yield elastically when a force is applied.

Early compliant pliers used living hinges to replace the pivot points found in traditional rigid-body pliers. These living hinges were very thin and therefore very flexible. Essentially, the early compliant pliers used rigid-body construction and simply replaced the conventional pivot pins with thin flexible living hinges. Unfortunately for users of such early compliant pliers, these thin living hinges lacked the ability to transmit substantial forces and often showed signs of stress marks, indicating a temporary disposable product.

What is needed is an improved compliant pliers that is easy to manufacture and able to transmit substantial forces. Such compliant pliers could be used for pinching, gripping, clamping, or holding a wide variety of objects.

In accordance with the present invention, pliers include an endless loop, a top jaw appended to the endless loop, and a bottom jaw appended to the endless loop. The endless loop includes in series a top grip handle, a spring segment, a bottom grip handle, and a compliant strip interconnecting the top and bottom grip handles. The spring segment interconnects the top and bottom grip handles.

Each of the top and bottom jaws are appended to the compliant strip to move with the compliant strip. The pliers further includes rolling means on the top grip handle for rolling on a contact portion of the bottom grip handle to translate the compliant strip longitudinally relative to the top and bottom grip handles in response to movement of the top grip handle toward the bottom grip handle as the pliers are squeezed by a user. This will cause the top jaw to move toward the bottom jaw to grip an object positioned between the top and bottom jaws.

In preferred embodiments, the endless loop and the top and bottom jaws are molded of a plastics material. Preferably, the compliant strip is somewhat U-shaped and has a nearly uniform thickness. It includes a top compliant segment coupled to the top grip handle, a bottom compliant segment coupled to the bottom grip handle, and a middle compliant segment interconnecting the top and bottom compliant segments. Illustratively, the middle compliant segment is curved and has a concave surface facing toward the top and bottom grip handles.

Illustratively, the spring segment is C-shaped and has a concave surface facing toward the concave surface of the middle compliant segment. The spring segment is configured to urge the top and bottom grip handles normally to a spread-apart position wherein the compliant strip appended to the top and bottom grip handles is moved, causing the top and bottom jaws to move apart to an object-receiving position.

By manually squeezing the top and bottom grip handles together against the restoring force generated by the spring segment, a user is able to roll a curved portion of the rolling means on the top grip handle along a curved contact portion on the bottom grip portion. This rolling action causes the compliant strip to flex or deform and such movement of the compliant strip causes the top and bottom jaws appended to the compliant strip to move toward one another to an object-gripping position.

The use of an endless loop in compliant pliers is advantageous in several respects. The endless loop is a closed-loop construction and provides a built-in automatic spring which functions to return the grip handles, compliant strip, and top and bottom jaws to neutral (stress-free) positions once the user releases the grip handles. The endless loop design also creates a moderate system resistance for enhanced user control and provides additional lateral stability. The endless loop design further protects flexural "pivots" from damage by limiting motion of the pliers components to a non-stressful range of motion.

Rolling longitudinal translating movement of contact engagement between contact portions appendant to the top and bottom grip handles is an improvement over pivot pins associated with traditional pliers. A rolling contact configuration can be varied easily by the pliers designer to change the mechanical advantage of the pliers without significantly altering the overall configuration of the compliant pliers. Merely by molding the compliant pliers to move the rolling contact members away from the jaws and toward the tails of the grip handles, it is possible to increase the mechanical advantage of the compliant pliers. The rolling contact design can also withstand large compressive forces generated by a user squeezing the grip handles without a significant loss of energy due to friction.

Compliant pliers including a compliant strip of the type supporting the object-gripping jaws and appended to the grip handles is an improvement over traditional pliers of the type using various pivot pins to create pivot points. This improved compliant strip design leads to higher force output and enhanced object gripping action at the jaws during use of the compliant pliers. It also makes it possible to use materials with superior mechanical properties to form the compliant pliers since the compliant strip need only have moderate flexibility.

There are many applications for one-piece compliant pliers in accordance with the present invention. For example, such pliers could be configured for use as a fish hook remover, forceps, or crafter's pliers. Also, it is well-suited for use as electronics and electricians' pliers and crimpers. The improved compliant pliers of the present invention is ideal for any application needing moderately high object-gripping forces with jaws capable of gripping delicate objects without damage to such objects.

Additional features and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 1 is a perspective view of a first embodiment of one-piece compliant pliers in accordance with the present invention showing a configuration suitable for use as a fish hook remover;

FIG. 2 is a side elevation view of the pliers of FIG. 1 in a neutral object-releasing position showing an endless loop including in series a top grip handle, a C-shaped spring, a bottom grip handle, a U-shaped compliant strip, and top and bottom jaws appended to the U-shaped compliant strip;

FIG. 3 is a transverse sectional view taken along line 3—3 of FIG. 2 showing a cross section of the buoyant plastics material used to form the bottom grip handle;

FIG. 4 is a view similar to FIG. 2 showing rolling contact between a curved rolling portion appended to the top grip handle and an underlying curved rolling portion appended to the bottom grip handle which causes the compliant strip to move and close the top and bottom jaws in response to a user squeezing the top and bottom grip handles;

FIG. 5 is an enlarged view of the compliant pliers of FIGS. 1, 2, and 4 showing movement of pliers components from a neutral position (dotted lines) to an object-gripping position (solid lines) and rolling contact of the rolling portions in a rearward direction away from the jaws;

FIG. 6 is a view of a second embodiment of the pliers of FIG. 1 showing an alternative grip handle construction;

FIG. 7 is a transverse sectional view taken along line 7—7 of FIG. 6 showing an I-beam cross section of the bottom grip handle;

FIG. 8 is a view of a third embodiment of the pliers of FIG. 1 showing another alternative grip handle construction;

FIG. 9 is a transverse sectional view taken along line 9—9 of FIG. 8 showing a presently preferred T-beam cross section of the bottom grip handle;

FIG. 10 is a view of a fourth embodiment of the pliers of FIG. 1 showing yet another alternative grip handle construction;

FIG. 11 is a transverse sectional view taken along line 11—11 of FIG. 10 showing a box-shape hollow bottom grip handle;

FIG. 12 is a view of a fifth embodiment of the pliers of FIG. 1 showing still another alternative grip handle construction;

FIG. 13 is a transverse sectional view taken along line 13—13 of FIG. 10 showing a bottom grip handle including a buoyant material inside a hollow frame made of plastics material;

FIG. 14 is a view of a sixth embodiment of the pliers of FIG. 1 showing yet another alternative grip handle construction;

FIG. 15 is a transverse sectional view taken along line 15—15 of FIG. 14 showing a bottom grip handle including a buoyant material inside a C-shaped hollow frame;

DETAILED DESCRIPTION OF THE DRAWINGS

Figure 16:
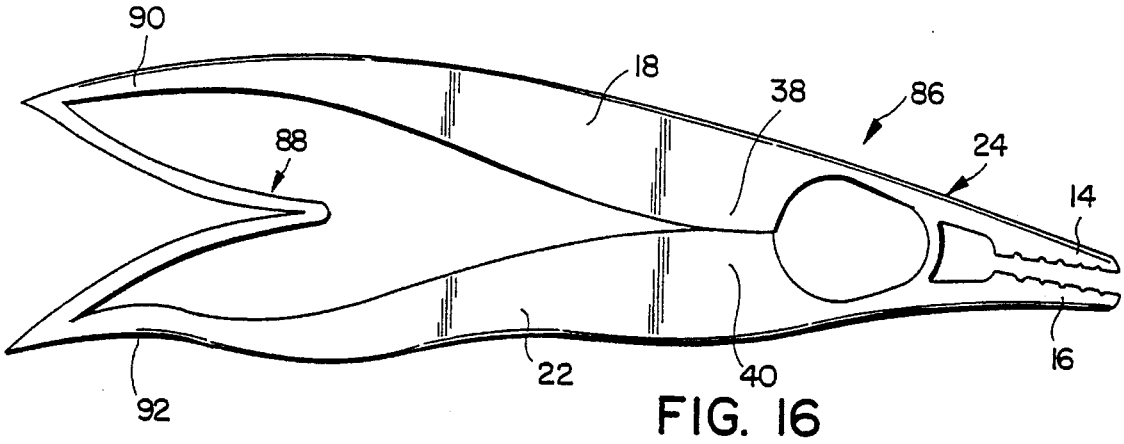
FIG. 16 is a view of another compliant pliers in accordance with the present invention showing a V-shaped return string configuration.

A one-piece compliant pliers 10 suitable for holding or gripping objects (not shown) is illustrated in FIG. 1. Pliers 10 is made of closed-loop construction and is configured to use rolling contact and compliant segments instead of conventional pivot pins to permit a user to grip an object with the pliers. The closed loop construction adds structural stability. The rolling contact design maximizes object-gripping forces by reducing unwanted friction. Pliers 10 also has an increased gripping force capacity because of its compliant design.

Referring to FIG. 1, pliers 10 includes an endless loop 12, a top jaw 14, and a bottom jaw 16. The endless loop 12 includes in series a top grip handle 18, a return spring 20, a bottom grip handle 22, and a compliant strip 24. The top and bottom jaws 14, 16 are appended to the compliant strip 24 to position the top and bottom jaws in normally spaced-apart confronting relation as shown in FIGS. 1 and 2. Pliers 10 is preferably a single molded piece made of a suitable plastics material.

The compliant strip 24 is a generally U-shaped member including a top compliant segment 26 appended to the top grip handle 18 and a bottom compliant segment 28 appended to the bottom grip handle 22. The compliant strip 24 also includes a curved middle compliant segment 30 interconnecting the top and bottom compliant segments 26, 28. The curved middle compliant segment 30 has a concave surface 32 facing toward the grip handles 18, 22 and the return spring 20 and a convex surface facing toward the jaws 14, 16. The top jaw 14 is appended to the compliant strip 24 at a junction between the top and middle compliant segments 26, 30 and the bottom jaw 16 is appended to the compliant strip at a junction between the bottom and middle compliant segments 28, 30. Although the middle compliant segment 30 is curved in the illustrated embodiment, it will be understood that segment 30 could be formed to assume a wide variety of shapes including a somewhat straight shape (not shown).

The return spring 20 is illustratively integrated with the grip handles 18, 22 and has a concave surface 36 facing toward the compliant strip 24 and the jaws 14, 16 as shown best in FIGS. 1–3. The return spring 20 is sized and proportioned to return the grip handles 18, 22, compliant strip 24, and jaws 14, 16 to the neutral position shown in FIGS. 1 and 2 once the user releases the pliers 10 after squeezing the pliers 10 as shown, for example, in FIG. 4.

A first contact member 38 is appended to the underside of top grip handle 18 and a second contact member 40 is appended to bottom grip handle 22 as shown in FIGS. 1 and 2. The second contact member 40 is positioned to engage the first contact member 38 whenever the top and bottom grip handles 18, 22 are squeezed together by opposing forces 42, 44 generated by a user as shown in FIG. 3. The first and second contact members 38, 40 are curved so that rolling contact is established between these contact members 38, 40 each time the pliers 10 are squeezed to grip an object in jaws 14, 16. This rolling contact between contact members 38, 40 is illustrated, for example, in FIG. 5 wherein it is shown that initial contact between contact members 38, 40 is at point A and final contact is at point B following rolling movement of contact member 38 relative to contact member 40 during use of pliers.

The endless loop 12 is formed to define an interior region 46 as shown best in FIG. 2. The contact members 38, 40 are positioned to lie in this interior region 46 and between the C-shaped return spring 20 and the U-shaped compliant strip 24. Advantageously, it is easy to increase the mechanical advantage of pliers 10 at the design stage merely by varying the shape and location of contact members 38, 40 to move the contact points A, B aft on pliers 10 in direction 48 away from jaws 14, 16 and toward the C-shaped return spring 20. This design change can be accomplished without significant change to configuration of return spring 20, compliant strip 24, or top and bottom jaws 14, 16. Therefore, compliant pliers 10 can be used for either a high or a low mechanical advantage design depending upon the placement of the contact member 38, 40 relative to the compliant strip 24.

Preferably, the endless loop 12 and jaws 14, 16 are made of a plastics material such as Acetal. As shown in FIG. 3, the pliers 10 are preferably made of a plastics material filled with micro voids. This enhances the buoyancy of plies 10 which is desirable if the pliers 10 will be used around water such as in a fish hook remover application. These micro voids or bubbles are easily created by injecting molten plastics material with nitrogen gas during molding. The micro voids improve the structural quality and also reduce the specific gravity enough to permit pliers 10 to float. Alternatively, the molten plastics material can be mixed with a chemical gassing agent prior to an injection molding process.

In use, the top and bottom grip handles 18, 22 are squeezed together as shown in FIGS. 4 and 5 against the bias of spring 20 causing compliant strip 24 to flex outwardly in directions 50, 52 so that jaws 14, 16 move toward one another in directions 54, 56. Once these squeeze forces 42, 44 are released, the pliers 10 are automatically restored by return spring 20 to the neutral position shown in FIGS. 1 and 2.

When configured to function as a fish hook remover, the one-piece compliant pliers 10 are designed to make it easy for users to remove fish hooks. Pliers 10 are a compliant mechanism; that is, portions of the mechanism flex while other portions remain rigid. When the rigid grip handles 18, 22 are squeezed, flexural portions of compliant strip 24 transfer the forces and motions to the jaws 14, 16. The jaws 14, 16 firmly grasp the hook (not shown) so that it can be removed from a fish. The gripping forces that can be applied due to a high mechanical advantage make it much easier to remove hooks with minimal hand force. Advantageously, the pliers 10 is molded as a complete mechanism and requires no assembly. It will sustain thousands of cycles without failure and will not corrode or rust.

Various cross-sectional grip handle shapes are shown in FIGS. 6–14. An I-beam shape for grip handles 58, 60 is shown in FIGS. 6 and 7 and a T-beam shape for grip handles 62, 64 is shown in FIGS. 8 and 9. A T-beam shape made of a buoyant plastics material is presently preferred. A hollow box shape for grip handles 66, 68 is shown in FIGS. 10 and 11. A hollow box design including a hollow frame 70 made of plastics material and filled with buoyant material 72 is shown in FIGS. 12 and 13 for grip handles 74, 76. This can be accomplished by molding the pliers around a foam core 72. A U-shaped channel design including a U-shaped frame 78 made of plastics material and filled with buoyant material 80 is shown in FIGS. 14 and 15 for grip handles 88, 84. This can be accomplished by molding pliers to include channels and then filling the channels with closed cell foam 80.

Figure 17:
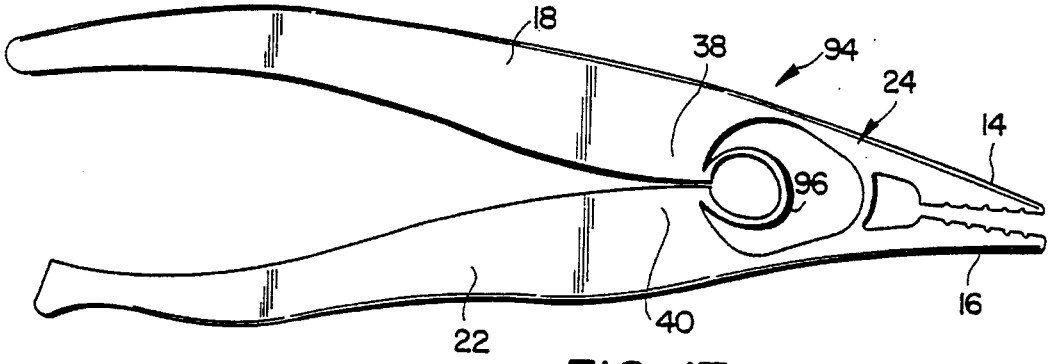
FIG. 17 is a view of still another compliant pliers in accordance with the present invention showing a nearly O-shaped internal return spring configuration.
Figure 18:
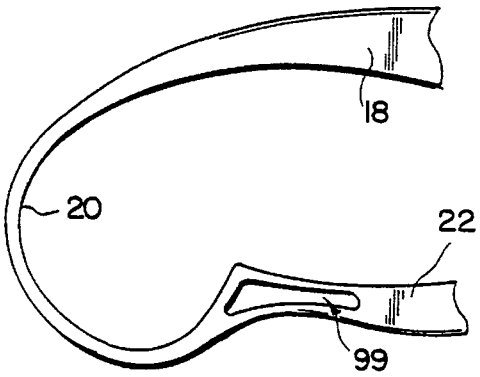
FIG. 18 is a view of a portion of the pliers of FIG. 1 showing a hollowed out portion of the bottom grip handle.

Alternative closed-loop constructions are shown in FIGS. 16 and 17. Pliers 86 shown in FIG. 16 includes a V-shaped return spring 88 appended to rearward ends 90, 92 of top and bottom grip handles 18, 22. Pliers 94 includes a nearly O-shaped internal return spring 96 appended to a forward end of the first contact member 38 and a forward end of second contact member 40 as shown in FIG. 17. As shown in FIG. 18, it may be necessary to add a gap 99 in the bottom grip handle 22 to get enough flexibility in spring 20.

Figure 20:
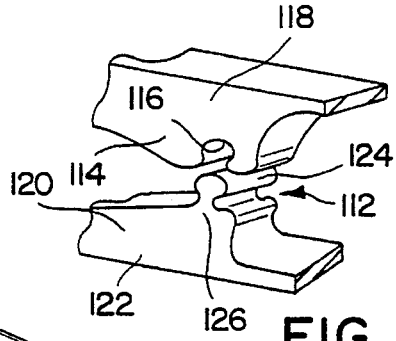
FIG. 20 is a view of the revolute joint of FIG. 19 prior to insertion of the roller member appended to the bottom grip handle into the roller-receiving receptacle formed in the top grip handle.
Figure 19:
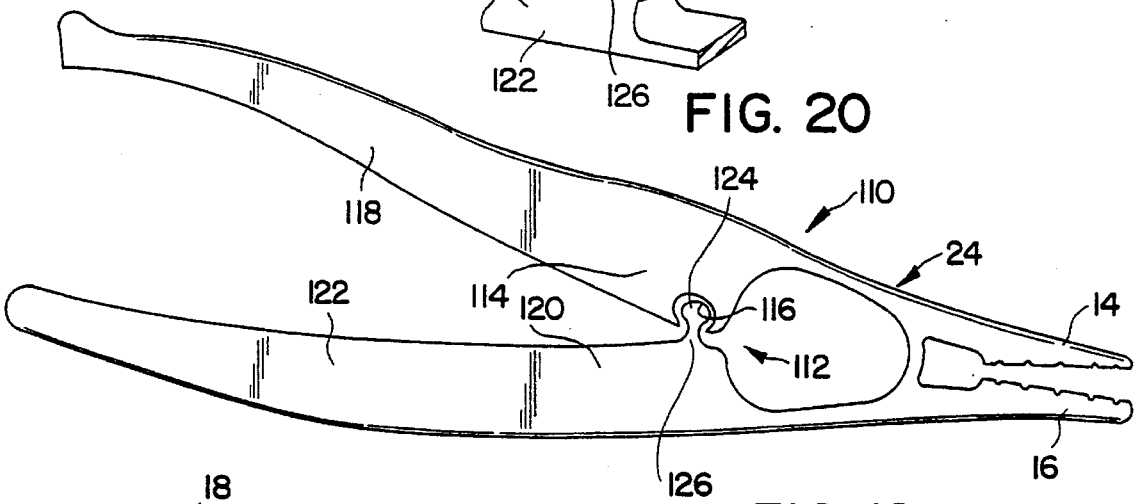
FIG. 19 is a view of another compliant pliers in accordance with the present invention showing a closed-loop construction using a revolute joint rather than rolling contact.

Another closed-loop compliant pliers 110 is illustrated in FIGS. 19 and 20. Pliers 110 is of closed-loop construction and uses a revolute joint 112 between top grip handle 118 and bottom grip handle 122 instead of the rolling contact engagement shown in the embodiments of FIGS. 1–18. The top grip handle 18 includes a first appendage 114 that is formed to include a roller-receiving socket 116 and the bottom grip handle 122 includes a second appendage 120 that is formed to include a roller 124 on a stem 126. Preferably, one-piece compliant pliers 110 would be molded of plastics material with the revolute joint 112 open and then the roller 124 would be snapped or twisted or slid into the roller-receiving socket 116 to assemble pliers 110.

Figure 21:
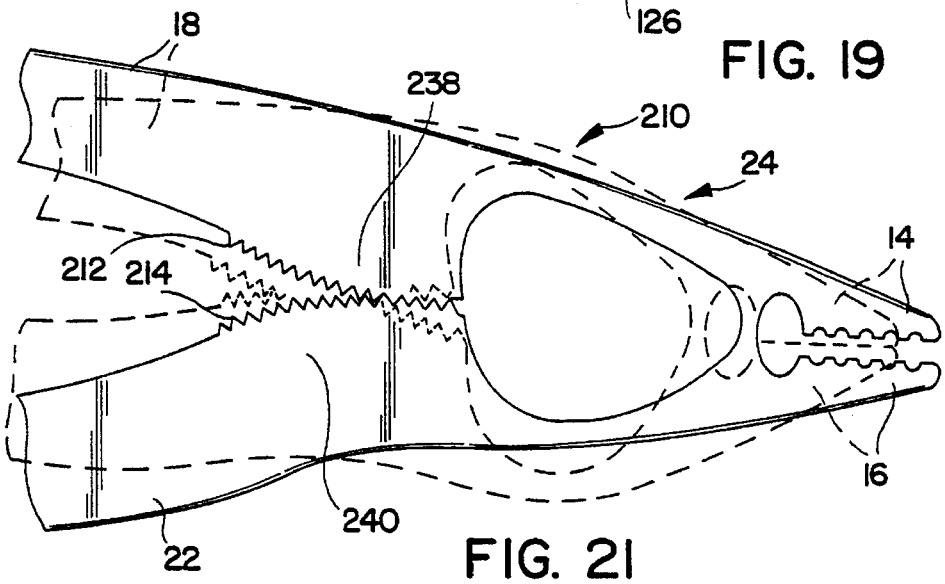
FIG. 21 is a view of still another compliant pliers in accordance with the present invention using a tooth-type rolling contact.

Yet another closed-loop compliant pliers 210 is illustrated in FIG. 21. Pliers 210 is similar to pliers 10 in all respects except that the rolling contact between first and second contact members 238, 240 is accomplished using teeth instead of smooth surfaces. Illustratively, a first series of teeth 212 formed on first contact member 238 engage a second series of teeth 214 formed on the second contact member 240.

Although the invention has been described and defined in detail with reference to certain preferred embodiments, variations and modifications exist within the scope and spirit of the invention as described and defined in the following claims.

We claim:

1. Pliers comprising;

an endless loop including in series a top grip handle, a spring segment, a bottom grip handle, and a compliant strip interconnecting the top and bottom grip handles, the spring segment interconnecting the top and bottom grip handles, a top jaw appended to the compliant strip, a bottom jaw appended to the compliant strip and positioned to lie in confronting relation to the top jaw, and a pivot means portion on the top grip handle for providing a rearwardly longitudinally translatable pivot point on a contact area portion of the bottom grip handle, the contact area portion and the pivot means portion having a large gradual curved elongated configuration and a relatively large radius of curvature, an initial contact of the pivot point spaced rearwardly on the pivot means portion and the contact area portion, irrespective of asymmetrical loading on the grip handles, so as to move the compliant strip relative to the top and bottom grip handles in response to movement of the top grip handle toward the bottom grip handle as the top jaw moves toward the bottom jaw to grip an object positioned between the top and bottom jaws and so as to insure that the movable pivot point translates rearwardly along the curved contact area portion and away from the compliant strip along the contact area.

2. The pliers of claim 1, wherein the endless loop is made of a plastics material.

3. The pliers of claim 1, wherein the endless loop is made of a buoyant material.

4. The pliers of claim 1, wherein the endless loop has a frame made of a plastics material and a core in the frame made of a buoyant material.

5. The pliers of claim 1, wherein the compliant strip is U-shaped and includes a top compliant segment coupled to the top grip handle, a bottom compliant segment coupled to the bottom grip handle, and a middle compliant segment interconnecting the top and bottom compliant segments, each compliant segment has a width and a relatively smaller thickness, and the thickness of the middle compliant segment is about equal to the thickness of each of the top and bottom compliant segments.

6. The pliers of claim 5, wherein the middle compliant segment is curved.

7. The pliers of claim 6, wherein the middle compliant segment has a convex surface facing toward the top and bottom jaws and a concave surface facing toward the top and bottom grip handles.

8. The pliers of claim 5, wherein the top grip handle has a forward end integrally appended to the top compliant strip and an opposite rearward end, the bottom grip handle has a forward end integrally appended to the bottom compliant strip and an opposite rearward end, and the spring segment is a C-shaped member having a first end integrally appended to the rearward end of the top grip handle, a second end integrally appended to the rearward end of the bottom grip handle, and an annular middle portion interconnecting the first and second ends and having a concave surface facing toward the top and bottom grip handles.

9. The pliers of claim 5, wherein the top grip handle has a forward end integrally appended to the top compliant strip and an opposite rearward end, the bottom grip handle has a forward end integrally appended to the bottom compliant strip and an opposite rearward end, and the spring segment is a V-shaped member having a first leg integrally appended to the rearward end of the top grip handle, a second leg integrally appended to the rearward end of the bottom grip handle, and an apex portion interconnecting the first and second legs and positioned to lie between the rolling means and the rearward ends of the top and bottom grip handles.

10. The pliers of claim 1, wherein the endless loop is formed to include an interior region and the rolling means is positioned to lie in the interior region.

11. The pliers of claim 10, wherein the contact area portion of the bottom grip handle is positioned to lie in the interior region in confronting relation to an interior pivoting area on the top grip handle.

12. The pliers of claim 11, wherein the contact area portion includes a first curved surface facing toward the pivot point and the pivot point includes a second curved surface facing toward the bottom grip handle and wherein the first surface contacts with the second surface along a point of contact and with the point of contact translating engaging the first curved surface upon movement of the top grip handle toward the bottom grip handle.

13. The pliers of claim 12, wherein the first curved surface is convex.

14. The pliers of claim 13, wherein the second curved surface is convex.

15. The pliers of claim 1, wherein the spring segment is a C-shaped member.

16. The pliers of claim 15, wherein the top grip handle has a forward end integrally appended to the compliant strip and an opposite rearward end, the bottom grip handle has a forward end integrally appended to the compliant strip and an opposite rearward end, and the spring member has a first end integrally appended to the rearward end of the top grip handle, a second end integrally appended to the rearward end of the bottom grip handle, and an annular middle portion interconnecting the first and second ends and having a concave surface facing toward the top and bottom grip handles.

17. Pliers comprising an endless loop made of plastics material and formed to include an interior region, the endless loop including a gripping portion and a compliant strip, a top jaw appended to the compliant strip of the endless loop and positioned to lie outside the interior region, a bottom jaw appended to the compliant strip of the endless loop and positioned to lie outside the interior region in confronting relation to the top jaw, a gradually curved elongated contact member having a relatively large radius of curvature appended to the endless loop and positioned to lie in the interior region and positioned to contact another gradually curved elongated portion of the endless loop at a point of contact, and said another portion having a relatively large radius of curvature along a longitudinal area thereof, said point of contact spaced rearwardly on the gradually curved contact and another portion in response to forces applied to the contact members and the other portion of the endless loop, and wherein the relatively large radius of curvature of the contact member and another portion and the rearwardly spaced contact causes rearward longitudinal translating of the point of contact along the area regardless of asymmetrical force loadings on the contact member and another portion of the endless loop, to deform the compliant strip in response to deformation of the gripping portion of the endless loop so that the top jaw moves toward the bottom jaw to grip an object positioned between the top and bottom jaws while the point of contact location moves rearwardly along the contact member and away from the compliant strip.

18. The pliers of claim 17, wherein the gripping portion includes a top grip handle and a bottom grip handle and the compliant strip interconnects the top and bottom grip handles and lies in a position between the rolling means and the top and bottom jaws.

19. The pliers of claim 18, wherein the endless loop further includes a spring segment appended to each of the top and bottom grip handles.

20. The pliers of claim 19, wherein the spring segment is C-shaped.

21. The pliers of claim 19, wherein the spring segment is V-shaped.

22. The pliers of claim 17, wherein the gripping portion includes a top grip handle and a bottom grip handle, the compliant strip is U-shaped and includes a top compliant segment coupled to the top grip handle, a bottom compliant segment coupled to the bottom grip handle, and a middle compliant segment interconnecting the top and bottom compliant segments, each compliant segment has a width and a relatively smaller thickness, and the thickness of the middle compliant segment is about equal to the thickness of each of the top and bottom compliant segments.

23. The pliers of claim 22, wherein the middle compliant segment is curved.

24. The pliers of claim 23, wherein the middle compliant segment has a convex surface facing toward the top and bottom jaws and a concave surface facing toward the top and bottom grip handles.

25. The pliers of claim 17, wherein the gripping portion includes a top grip handle appended to one end of the compliant strip and a bottom grip handle appended to the other end of the compliant strip, the contact member includes a first curved surface facing toward a second curved surface translatingly engaging the first curved surface upon movement of the top grip handle toward the bottom grip handle.

26. The pliers of claim 17, wherein the endless loop further includes a spring segment appended to each of the top and bottom grip handles.

27. Pliers comprising a top grip handle, a bottom grip handle including a gradual curved elongated contact portion with a large radius of curvature facing toward the top grip handle, a jaw means for gripping an object, the jaw means being integrally appended to each of the top and bottom grip handles, the jaw means being movable between an object-receiving position and object-gripping position, a gradual curved elongated pivot surface means on the top grip handle with a large radius of curvature for providing a longitudinal movable pivot point on the contact portion of the bottom grip handle, the pivot point spaced rearwardly on the pivot surface means and on the contact portion, wherein these radii of curvature of contact portion and the pivot surface means as well as the rearward location of the pivot point insures that the pivot point is translated rearwardly in response to movement of the top grip handle toward the bottom grip handle regardless of asymmetrical loading on the handles to move the jaw means to the object-gripping position as the movable pivot point translates rearwardly along the contact area and away from the jaw means, and a spring means for yieldably urging the top grip handle to move in a direction away from the bottom grip handle so that the jaw means is moved to its object-receiving position, the spring means being integrally appended to the top and bottom grip handles.

28. The pliers of claim 27, wherein the jaw means includes a compliant strip interconnecting the top and bottom grip portions, a top jaw appended to the compliant strip, and a bottom jaw appended to the compliant strip and positioned to lie in confronting relation to the top jaw and the compliant strip, top grip portion, spring means, and bottom grip portion are arranged in series to define an endless loop.

29. The pliers of claim 28, wherein the spring means is C-shaped.

30. The pliers of claim 28, wherein the spring means is V-shaped.

31. The pliers of claim 27, wherein the contact portion includes a first curved surface facing toward a second curved surface and the second surface facing toward the bottom grip handle and translating engaging the first curved surface upon movement of the top grip handle toward the bottom grip handle.

32. The pliers of claim 28, wherein the contact portion includes a first curved surface facing toward a second curved surface and the second surface facing toward the bottom grip handle and translatingly engaging the first curved surface upon movement of the top grip handle toward the bottom grip handle.

33. The pliers of claim 32, wherein the second curved surface is convex.

* * * * *